US005662250A

United States Patent [19]

Werling

[11] Patent Number: 5,662,250

[45] Date of Patent: Sep. 2, 1997

[54] BOW FORMING DEVICE

[75] Inventor: John M. Werling, Las Vegas, Nev.

[73] Assignee: Sandy M. Sandler, Henderson, Nev.

[21] Appl. No.: 497,257

[22] Filed: Jun. 30, 1995

[51] Int. Cl.[6] ..... A41H 43/00; B25B 1/00

[52] U.S. Cl. ..... 223/46; 223/44; 28/149; 269/256 CS

[58] Field of Search ..... 223/44, 46; 28/147, 28/149, 150; 269/254 CS

[56] References Cited

U.S. PATENT DOCUMENTS

| | | | |
|---|---|---|---|
| 2,529,452 | 11/1950 | Janes et al. | 269/254 CS |
| 2,542,222 | 2/1951 | Welch | 223/46 |
| 2,727,325 | 12/1955 | Jurinic | 269/254 CS |
| 2,763,080 | 9/1956 | Welch | 41/10 |
| 3,291,352 | 12/1966 | Grikis | 223/46 |
| 3,462,049 | 8/1969 | Smith | 223/46 |
| 3,583,026 | 6/1971 | Peoni | 269/254 CS |
| 3,816,888 | 6/1974 | Rather, Jr. | 28/2 |
| 4,454,968 | 6/1984 | St. Lawrence | 223/46 |
| 4,603,797 | 8/1986 | Gallo, Sr. | 223/46 |
| 4,714,182 | 12/1987 | Hecht | 223/46 |
| 5,356,056 | 10/1994 | Teuten | 223/46 |
| 5,407,108 | 4/1995 | Hambright | 223/46 |

FOREIGN PATENT DOCUMENTS

| | | | |
|---|---|---|---|
| 440400 | 2/1927 | Germany | 223/46 |

OTHER PUBLICATIONS

E–Z Bow Maker Instructions, E–Z Bowz, Inc., Sevierville, Tennessee, 1993.

E–Z Bowz Jr Instructions, E–Z Bowz Inc., Sevierville, Tennessee, 1993.

*Primary Examiner*—Bibhu Mohanty

*Attorney, Agent, or Firm*—Jacobson, Price, Holman & Stern, PLLC

[57] ABSTRACT

A device for forming bows from a ribbon which includes a base plate and a pair of uprights mounted on the base plate. One of the uprights is resiliently biased toward the other upright for grippingly engaging portions of the ribbon inserted therebetween to hold bow loops formed from the ribbon in place while forming the bow. A tie wire is placed between the uprights for securing the portions of the bow loops retained between the uprights before removing the assembled bow loops. The uprights have opposed narrow edges to effectively grip the ribbon positioned therebetween. In one embodiment of the invention, the uprights include spaced upright plates to receive the tie wire and a forming arm which moves the portions of the bow loops between the uprights toward the base plate.

20 Claims, 3 Drawing Sheets

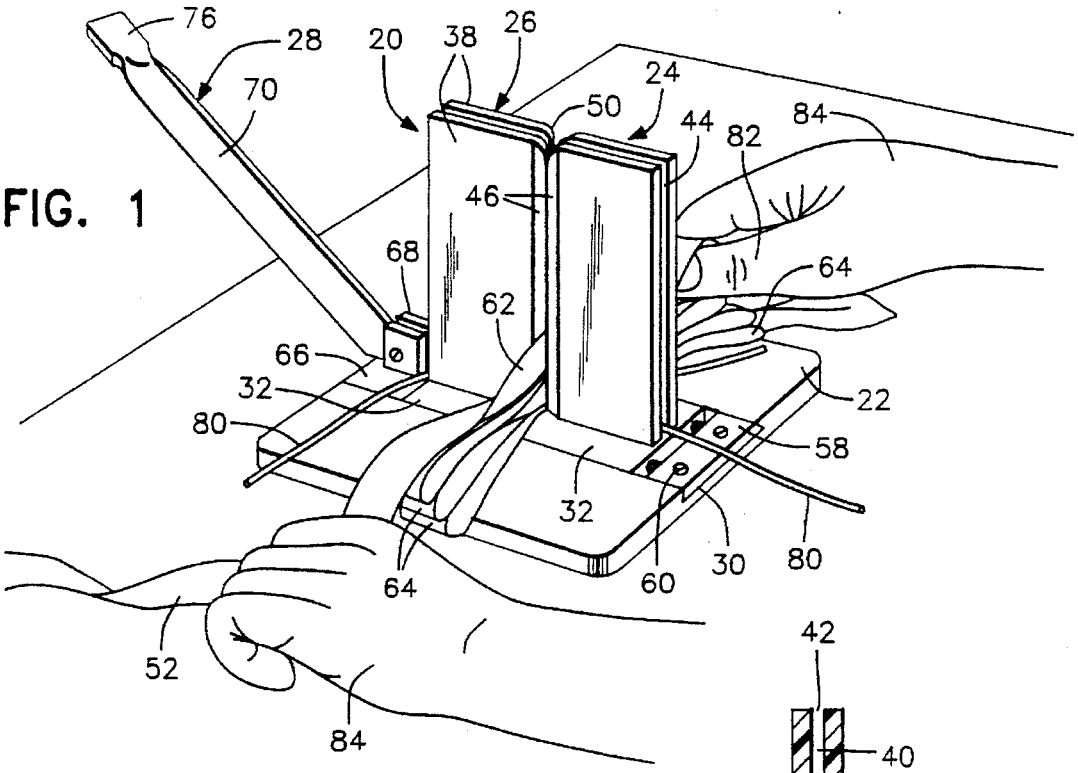
FIG. 1
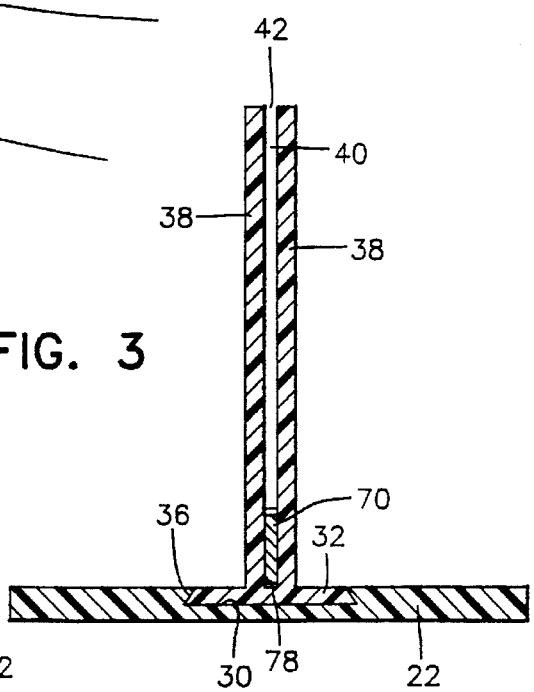
FIG. 3
FIG. 2
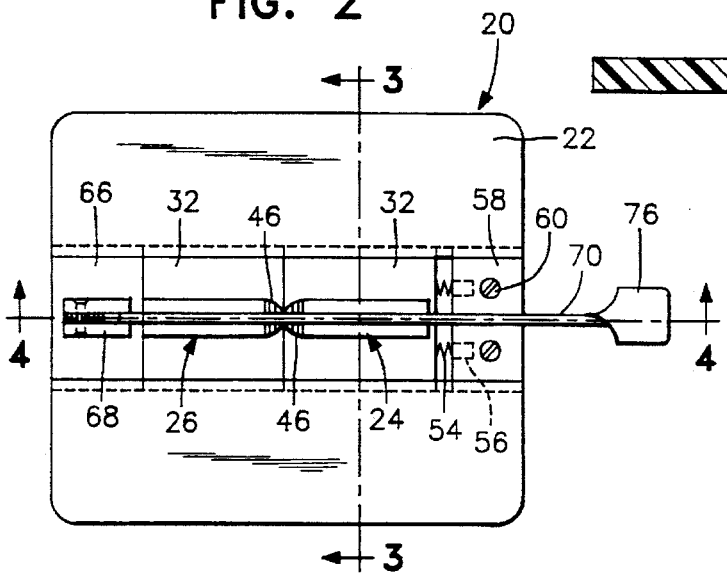

BOW FORMING DEVICE

BACKGROUND OF THE INVENTION

1. Field of the Invention

This invention relates to a device for forming bows from a ribbon which includes a base plate and a pair of uprights mounted on the base plate. One of the uprights is resiliently biased toward the other upright for grippingly engaging portions of the ribbon inserted therebetween to hold bow loops formed from the ribbon in place while forming the bow. A tie wire is placed between the uprights for securing the portions of the bow loops retained between the uprights before removing the assembled bow loops. The uprights have opposed narrow edges to effectively grip the ribbon positioned therebetween. In one embodiment of the invention, the uprights include spaced upright plates to receive the tie wire and a forming arm which moves the portions of the bow loops between the uprights toward the base plate.

2. Description of the Prior Art

The formation of bows from ribbon for use on packages and other decorative uses is well known. It is also well known that it is quite difficult to form a ribbon bow with a plurality of loops by merely holding the intersecting cross over portions of the loop between the thumb and fingers when forming a bow. In view of long existing difficulties in forming bows by holding the assembled bow in one hand while the loops are formed with the other, devices have been developed to assist in forming a bow. The following U.S. patents disclose structures for this purpose:

U.S. Pat. No. 2,542,222

U.S. Pat. No. 2,763,080

U.S. Pat. No. 3,816,888

U.S. Pat. No. 4,454,968

U.S. Pat. No. 5,356,056

The above patents include pegs or dowels which extend upwardly from a base plate in spaced relation on which bow loops are formed. In some of the patents, the base plate includes an upwardly extended pointed member which penetrates the overlapping, intersecting portions of the bow loop. In other of the patents, the bow is formed by forming loops around a plurality of adjacent pegs or dowels. Another device for forming bows has been marketed under the trademark "Easy Bow Maker" manufactured by E-Z BOWZ, Inc. of Sevierville, Tenn. This device is a base plate with a pair of spaced dowels or pegs mounted rigidly thereon with the dowels receiving the overlapping, intersecting portions of the bow loops therebetween to hold the loops in assembled relation until they can be removed and secured by a wire wrapped around the intersecting portions of the loops to secure the bow in assembled relation. In some instances, distance indicating indicia may be provided on the base plate to facilitate the formation of bow loops of different lengths in order to form bows having various configurations.

While the prior art discloses various devices to assist in the formation of bows from various types of ribbon, the prior art does not disclose a bow forming device that is structurally or functionally equivalent to this invention.

SUMMARY OF THE INVENTION

An object of the present invention is to provide a bow forming device to assist in the formation of various types of bows in the form of a base plate having a pair of uprights mounted thereon with at least one of the uprights being laterally moveable in relation to the other and spring biased toward the other to grippingly engage intersecting or cross over overlapping portions of the bow loops to retain the bow loops in assembled relation while being formed and enabling the intersecting cross over overlapping portions of the bows to be secured in assembled relation prior to removal from the bow forming device.

Another object of the invention is to provide a bow forming device in accordance with the preceding object in which the spring biased movement of one of the uprights assures that the gripping surfaces of the uprights which engage the intersecting cross over overlapping portions of the bows remain in parallel relation to grippingly engage each intersecting, cross over overlapping portion of the bows with substantially equal gripping pressure.

A further object of the invention is to provide a bow forming device in accordance with the preceding objects in which the gripping or engaging surfaces of the uprights are bevelled or tapered to form generally a narrow or knife edge gripping contact with the overlapping portions of the bows.

Still another object of the invention is to provide a bow forming device in which the uprights are in the form of a pair of vertically extending, spaced plates to receive a forming arm therebetween with the forming arm being moveable downwardly in the space between the plates on each upright to engage and move downwardly the intersecting cross over overlapping portions of the loops during assembly of the bow.

A still further object of the invention is to provide a pivotal mounting for the forming arm to enable the forming arm to pivot in a vertical plane when moving downwardly in the space between the upright plates.

Yet another object of the invention is to provide a bow forming device in accordance with the preceding object in which the pivotal support of the forming arm includes a structure to enable the forming arm to be detached and inserted horizontally in the space between the upright plates in order for the forming arm to be moved vertically downwardly to engage and move the intersecting cross over overlapping portions of the bow loops downwardly to facilitate assembly of bow loops formed from relatively wide ribbon.

Another significant object of the invention is to provide a bow forming device including a base plate with a pair of spaced uprights with one of the uprights being slidingly mounted on the base plate and spring biased towards the other upright by a pair of compression coil springs with the uprights being in the form of pegs having facing gripping edges defined by bevelled or inclined edge portions.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the bow forming device of the present invention illustrating the manner in which the ribbon is placed between the uprights to form bow loops.

FIG. 2 is a top plan view of the bow forming device.

FIG. 3 is a transverse, sectional view, on an enlarged scale, taken along section line 3—3 on FIG. 2 illustrating the slot defined by the space between the upright plates for receiving the forming arm therebetween.

DESCRIPTION OF THE DISCLOSED EMBODIMENTS

Figure 4:
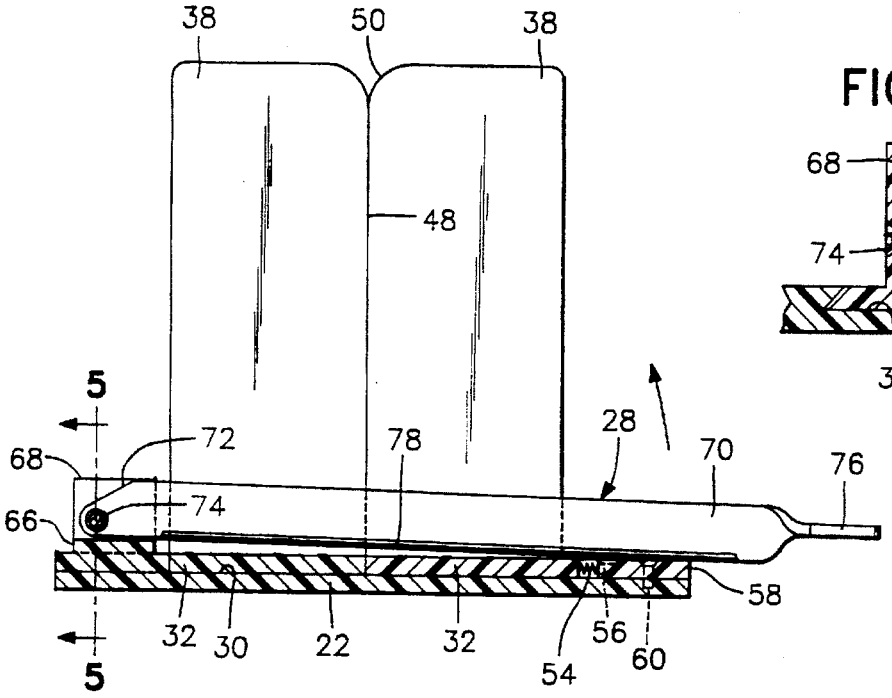
FIG. 4 is a longitudinal sectional view, on an enlarged scale, taken along section line 4—4 on FIG. 4 illustrating further structural details of the bow forming device.
Figure 5:
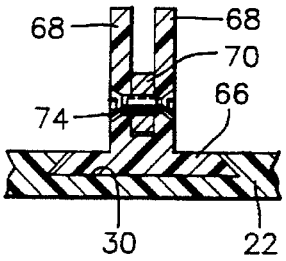
FIG. 5 is a sectional view, on an enlarged scale, taken along section line 5—5 on FIG. 4 illustrating the structure of the mounting plate for pivotally supporting the forming arm.

The bow forming device illustrated in FIGS. 1–5 is designated by reference numeral 20 and includes a generally rectangular base plate 22 having a pair of uprights 24 and 26 mounted therein in opposed relation and a forming arm generally designated by reference numeral 28 pivotally supported from the base plate 22 in alignment with and for cooperation with the uprights as set forth in detail hereinafter.

The base plate 22 includes a dovetail groove 30 in the upper surface thereof which extends from edge to edge of the base plate. Each upright 24 and 26 includes an upright base 32 having inclined side edges 36 cooperating with the dovetail groove 30 to enable the upright bases 32 to be moved into the groove 30 by an endwise sliding movement. Rigidly affixed thereto or unitary with the upright base 32 is a pair of spaced upright plates 38 which are generally rectangular and parallel to each other with the upright plates 38 being spaced apart to define a slot 40 having an open upper end 42 and open side edges 44. The upright plates 38 are parallel to each other and perpendicular to the upright base 32 on each of the uprights 24 and 26. The side edges of the upright plates 38 which are disposed in opposed, aligned relation are chamfered at 46 by beveling or rounding the edges from the outer surface toward the inner surface as illustrated in FIG. 2 to form a narrow or knife edge 48 on the opposed edges of the upright plates 38 on the uprights 24 and 26 respectively. The upper end of each of the opposed facing edges of the upright plates 38 are rounded or radiused as at 50 to facilitate the insertion of ribbon 52 between the uprights 24 and 26 in a manner described hereinafter.

The upright 26 is stationary while the upright 24 is spring biased towards the upright 26. Spring biasing of the upright 24 is provided by a pair of small compression springs 54 received in socket 56 in an inner edge of an end plate 58 which has inclined side edges slidable into the dovetail groove 30 and detachably secured thereto by screws 60 or other fasteners to enable removal of the end plate 58 for replacement of the springs 54 and for assembly and disassembly of the uprights in relation to the base plate. As illustrated in FIGS. 2 and 4, the springs 54 are relatively short to enable limited resilient movement of the upright 24 away from the upright 26 with the springs 54 normally biasing the upright plates 38 on the upright 24 into engagement with the upright plates 38 on the upright 26 bus enabling movement of the upright 24 away from the upright 26 when a ribbon 52 is forced downwardly between the chamfered edges 46 on the plates 38 on the uprights 24 and 26. Movement of the upright 24 is guided by the upright base 32 engaging the dovetail groove 30 which will maintain the chamfered edges 46 of the upright plates 38 on the upright 24 parallel to the chamfered edges 46 on the upright plates 38 on the upright 26. This structure effectively grips the intersecting, cross over overlapping portions 62 of the ribbon when forming bow loops 64.

The forming arm 28 includes a mounting plate 66 for the arm which includes inclined edges for assembly with the dovetail groove 30. Projecting upwardly from the mounting plate 66 for the arm is a pair of spaced plates or lugs 68. The forming arm 28 includes an elongated bar 70 of rectangular cross sectional configuration as illustrated in FIG. 3 having an inclined end 72 received between the pivot lugs 68 and pivotally connected thereto by a pivot pin or bolt 74. The opposite end of the bar 70 is provided with a handle 76 formed by twisting the end of the bar so that it is in perpendicular relation to the remainder of the bar. As illustrated, the thickness of the bar 70 is generally equal to but slightly less than the width of the slot 40 so that the forming arm 28 can swing in a vertical plane about the pivot pin 74 from the outwardly inclined position illustrated in FIG. 1 with the inclined edge 72 engaging the top surface of the mounting plate 66 to a generally horizontal position as illustrated in FIG. 4. When the forming arm 28 is swung from the position of FIG. 1 toward the position of FIG. 4, the lower edge thereof will engage the intersecting, cross over overlapping portion 62 of the ribbon 52 and move these portions downwardly by exerting downward clamping force thereon thus moving the portions 62 into intimate, contacting and generally clamped relation. The bottom edge of the forming arm bar 70, when oriented horizontally as in FIG. 4, is radiused or rounded at 78 to facilitate relative movement between the upper surface of the ribbon and the edge of the bar which engages the ribbon as the bar is pivoted about the pivot pin 74.

When forming a bow, a thin ductile wire 80 is positioned through the slots 40 and onto the upper surface of the base plate 22 with the ends thereof oriented so they do not interfere with placement of the ribbon 52. The ends of the wire can be grasped and wrapped around the portions 62 of the bow loops after all of the bow loops have been formed thus enabling the bow loops to be retained in position and secured in position prior to the bow loops being removed from the bow forming device. When forming a bow, a length of the ribbon is positioned between the uprights and moved downwardly and successive bow loops are formed by looping the ribbon over the thumbs and moving sequential portions of the ribbon downwardly to form the intersecting cross over overlapping portions 62. The length of the bow loops 64 may be selected by positioning the thumbs 82 on the hands in a selected distance from the uprights while the ribbon is looped around one thumb by the other hand with the ribbon being pushed downwardly between the uprights which frictionally and resiliently grip the portion of the ribbon inserted between the uprights. Thus, the length of the ribbon loops 64 can be varied such as by providing a plurality of lower loops of a longer length and a plurality of upper loops of a shorter length so that when the bow is fluffed out, a decorative bow will be formed.

The forming arm can be used each time a bow loop is formed or several bow loops can be formed and then the forming arm can be used. Also, depending upon the surfaces of the ribbon, the portion of the ribbon received between the uprights can be twisted to maintain the finished surface of a ribbon in upwardly facing relation. Once the bow has been completed, the ends of the wire 80 may be pulled upwardly around the intersecting cross over overlapping portions 62 and snugged around these portions and twisted to retain the intersection cross over overlapping portions 62 in tightly secured relation. The bow loops 64 can then be fluffed out by moving them laterally to evenly distribute the bow loops on each side of the bow forming device. The partially fluffed out bow can then be removed and the bow loops completely fluffed out so that they are equally spaced around the periphery of a bow. The ribbon 52 is cut from a supply roll or the like and the ends of the ribbon oriented adjacent each other. Various bow configurations and arrangements may be formed by using various types of ribbons, ribbons from various materials and colors with the ribbon loops being of different lengths and configurations.

In constructing the bow forming device 20, the base plate 22 may be molded with a dovetail groove 30 therein and is preferably constructed of plastic material. Likewise, the uprights 24 and 26, the mounting end plate 66 with lugs 68 and the end plate 58 may be molded of plastic material. This enables the components to be packaged and transported in a knocked down condition with the components being inserted into the groove 30 and secured in place therein with the mounting end plate 66 being stationarily supported either by screws or by adhesive material. The upright 26 may be positioned against the stationary mounting end plate 66 and, if desired, can be glued into position. The upright 24 remains free to move with the springs 54 biasing the upright 24 toward the upright 26. The upright base 32 maintains the upright plates 38 on the upright 24 parallel to the upright plates 38 on the upright 26 so that the chamfered edges 46 remain equally spaced during movement of the upright 24 which is permitted by compression and expansion of the springs 54. The end plate 58 is preferably anchored by screws 60 to enable assembly of the components and also enable the end plate 58 to be removed to replace the springs 54 in the event replacement becomes necessary. The forming arm 28 can be constructed of a lightweight metal or of plastic material having sufficient rigidity to function to pivot in a vertical plane to engage the portions of the ribbon extending between the uprights for moving the portions 62 of the ribbon downwardly into a compressed or compacted relation. As an alternative to using screws or glue, the end plates 58 and 66 can be snap locked in position by forming semispherical balls or detents on the bottom of the end plates and corresponding recesses or sockets in the bottom of groove 30. Also, the base plate, uprights and end plates can be constructed of metal when constructing a bow making device for commercial use.

Figure 6:
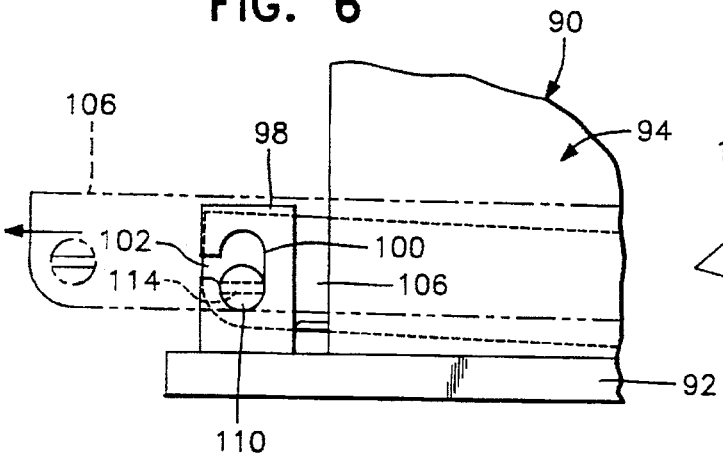
FIG. 6 is a fragmental elevational view illustrating another embodiment of the invention in which the pivotal support for the mounting arm includes a detachable connection to enable the pivotal end of the forming arm to be separated from the pivotal support for horizontal orientation when moved vertically in the slot between the upright plates.
Figure 7:
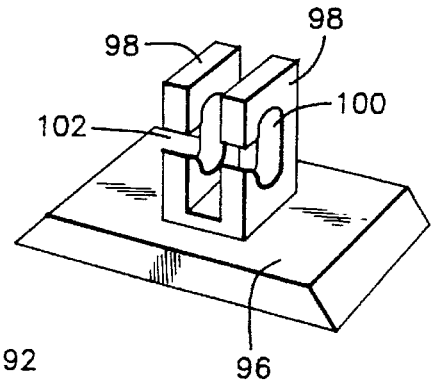
FIG. 7 is a perspective view of the mounting plate for the arm illustrated in FIG. 6.
Figure 8:
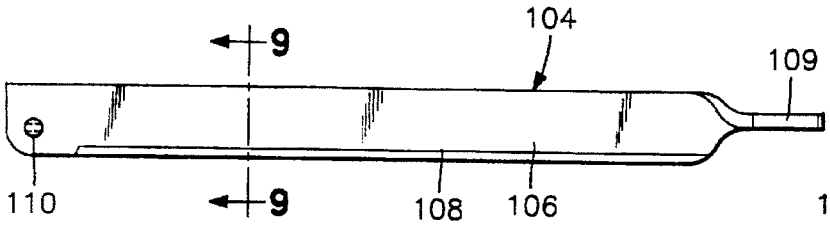
FIG. 8 is a side elevational view of the mounting arm illustrated in FIG. 6.

FIGS. 6–9 illustrate another embodiment of the bow forming device designated fragmentally and generally by reference numeral 90 which is identical to the structure illustrated in FIGS. 1–5 with respect to the base plate 92 and uprights 94 with only one upright being partially illustrated in FIG. 6. In this embodiment of the invention, the mounting end plate 96 is provided with upstanding, spaced pivot plates 98 having a vertically disposed oval shaped aperture 100 therein with the outwardly facing edge of the pivot plates 98 including a slot or notch 102 communicating with the oval shaped aperture 100 as illustrated in FIGS. 6 and 7.

Figure 9:
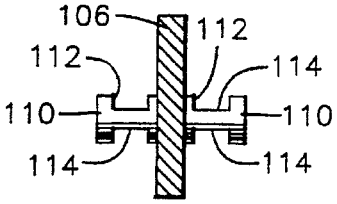
FIG. 9 is a transverse, sectional view taken along section line 9—9 on FIG. 8 illustrating further structural details of the forming arm including the grooved studs providing for pivotal movement of the arm in FIG. 6 and also detachable engagement with the mounting plate.

A forming arm 104 is detachably and pivotally connected to the mounting end plate 96 with the forming arm 104 including an elongated bar 106 of rectangular cross sectional configuration as illustrated in FIG. 9 with a rounded lower edge 108. One end of the bar includes a handle 109 formed by twisting one end of the bar and the other end of the bar 106 is provided with a laterally extending pivot stud 110 projecting from both sides of the bar 106 as illustrated in FIG. 9. Each of the pivot studs 110 is of cylindrical configuration and includes opposed notches 112 defined by parallel bottom surfaces 114. The distance between the bottom or inner walls 114 of the notches 112 are spaced apart a distance generally equal to the vertical height of the slots or notches 102 in the spaced pivot plates 98 so that when the surfaces 114 are registered with the notches 112, the forming arm 104 can be moved longitudinally with the studs elevated to align the surfaces 114 with the notches or slots 102. By moving the forming arm 104 longitudinally, as illustrated in broken line in FIG. 6, the forming arm can be detached from the pivot plates 98. The forming arm 104 can be reattached by reversing this movement. Thus, the forming arm 104 can be pivoted in the same manner as in FIG. 1 or it can be detached from the pivot plates 98 and oriented horizontally in the space between the upright plates on the uprights and then moved downwardly in a vertical manner while maintaining a horizontal orientation to enable the portions 62 of the ribbon 52 to be moved downwardly without any sliding engagement of the lower edge of the forming arm on the ribbon.

Figure 10:
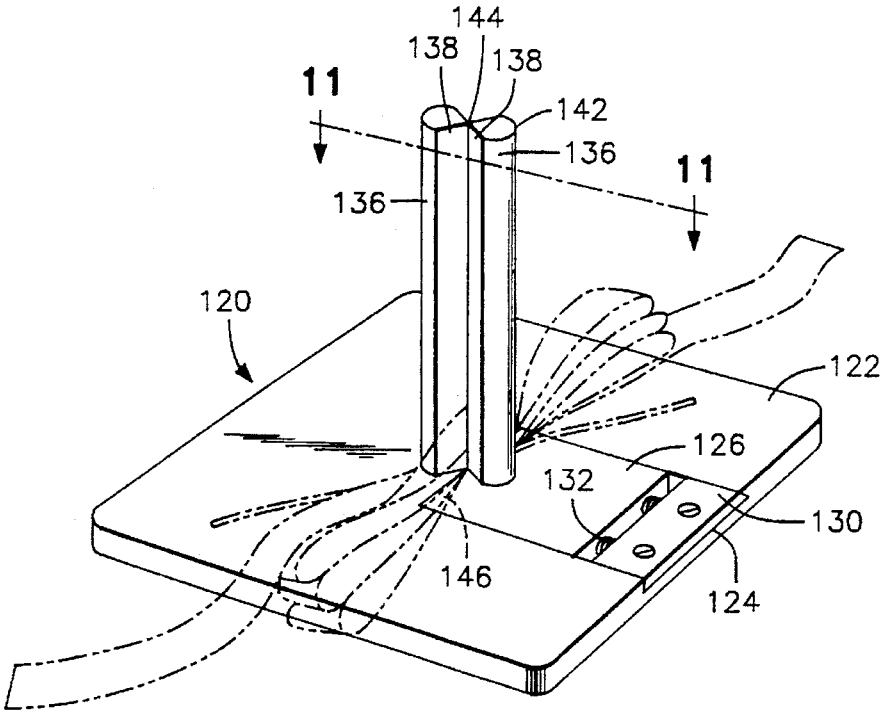
FIG. 10 is a perspective view of another embodiment of the invention utilizing upright dowels having opposed knife edge gripping edges with one of the dowels being resiliently moveable in relation to the other.
Figure 11:
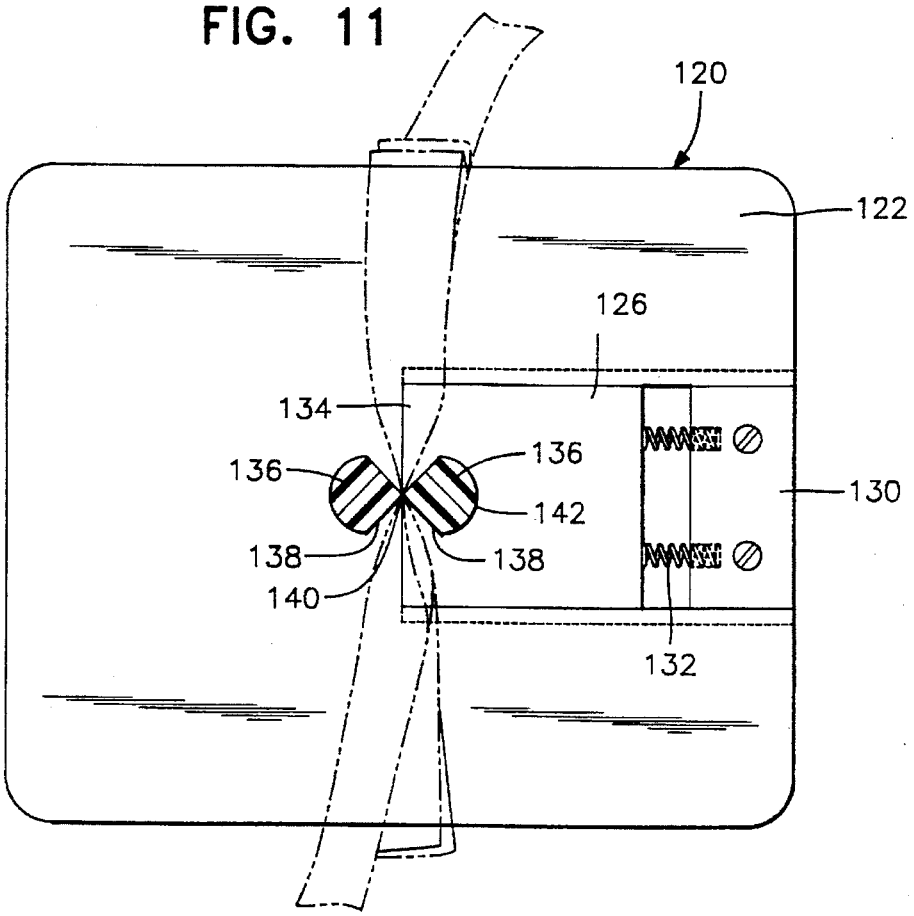
FIG. 11 is a plan sectional view, on an enlarged scale, taken along section line 11—11 on FIG. 10 illustrating the configuration of the pegs including their gripping edges.

FIGS. 10 and 11 illustrate another embodiment of the bow forming device generally designated by reference numeral 120 and which includes a base plate 122 with a dovetail groove 124 in the upper surface thereof receiving upright base plate 126, an end plate 130 having springs 132 mounted thereon for biasing the upright base 126 inwardly. This structure is similar to that disclosed in FIGS. 1–5 but in this construction, the groove 124 can be closed at one end as indicated at 134. Each of the upright base 126 and base plate 122 includes an upwardly extending peg 136 which includes tapered or bevelled surfaces 138 defining a narrow knife edge 140. The bevelled surfaces 138 are interconnected by a generally semicylindrical surface 142 and the upper inner corner of the knife edge is rounded at 144 to facilitate entry of ribbon portions 146 between the pegs for downward movement between the pegs with the springs 132 providing a gripping engagement with the ribbon portions 146 to facilitate formation of bow loops and a bow in the same manner as described in connected with FIGS. 1–5.

The forming arm is not used in FIGS. 10 and 11 but the resilient bias of one of the uprights is included in this embodiment of the invention which enables the knife gripping edge 140 on one of the upright pegs to resiliently move toward and away from the other and to remain in parallel relation thereto to provide a secure and constant gripping force to hold the ribbon portions 146 and more effectively secure the ribbon portions when forming a bow as compared to wood dowels that are anchored to a base at their lower ends and which tend to diverge as a plurality of ribbon segments are inserted between the dowels thus providing an insecure clamping engagement with the uppermost ribbon segments positioned between the dowels.

In the embodiment illustrated in FIGS. 10 and 11, one of the upright pegs 136 may be formed unitarily with the base plate 122 with the groove 124 terminating in registry with the knife edge 138 on the stationary peg 136. Thus, only the end plate 130, springs 132, upright base 126 and attached upright peg 136 are separate components. It is also pointed out that a tie wire will used with this embodiment of the invention in the same manner as in FIGS. 1–5 in order to form a decorative bow.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A bow making device comprising a base, a pair of planar uprights supported below from said base for receiving portions of bow forming material therebetween to enable bow loops to be formed in the material, means mounting at least one of said uprights on the base for relative movement toward and away from the other upright and maintaining the uprights in opposed parallel and aligned relation generally perpendicular to said base, each of said uprights including a clamping edge at the intersection of two surfaces, said clamping edges being disposed in opposed relation to clamp bow forming material disposed therebetween and means biasing the moveable upright towards the other upright to clampingly engage portions of the bow forming material between the uprights.

2. The bow forming device as defined in claim 1 wherein said means biasing the moveable upright includes compression coil spring means engaged with the base and moveable upright for resiliently biasing the moveable upright toward the other upright.

3. The bow forming device as defined in claim 2 wherein said means mounting the moveable upright on the base includes a longitudinal recess in an upper surface of the base, said moveable upright including a base plate slidable in the recess, said recess and base plate coacting to maintain the moveable upright parallel to the other upright.

4. The bow forming device as defined in claim 1 wherein each of said uprights is in the form of a vertically elongated peg, each of said clamping edges including converging inclined surfaces on each peg terminating in a narrow vertical clamping edge, the clamping edge on the moveable upright being in opposed alignment with the clamping edge on the other upright, said biased movement of the movable upright retaining the clamping edges in parallel relation.

5. A bow making device comprising a base, a pair of uprights supported from said base for receiving portions of bow forming material therebetween to enable bow loops to be formed in the material, means mounting at least one of said uprights on the base for relative movement in relation to the other upright and means biasing the moveable upright towards the other upright to clampingly engage portions of the bow forming material between the uprights, each of said uprights including a pair of spaced parallel upright plates mounted on an upright base plate, each pair of upright plates defining a space between the plates with the spaced plates and the spaces therebetween in each upright being aligned, a forming arm received in the space between the upright plates in each upright for movement toward the base for moving portions of the bow forming material gripped between the uprights downwardly toward the base.

6. The bow forming device as defined in claim 5 wherein said bow forming arm is an elongated bar having a thickness generally equal to the width of the space between the upright plates.

7. The bow forming device as defined in claim 6 together with means pivotally mounting one end of said forming arm to said base in remote relation to the moveable upright for pivotal movement of the forming arm in a vertical plane in the aligned spaces in the uprights.

8. The bow forming device as defined in claim 7 wherein the end of the forming arm remote from the pivotal connection to the base includes a handle to facilitate pivotal movement of the forming arm.

9. The bow forming device as defined in claim 6 wherein said bow forming arm is positioned horizontally in the aligned spaces in the uprights and moved vertically to move the portions of the bow forming material between the uprights downwardly toward the base.

10. The bow forming device as defined in claim 6 together with means detachably and pivotally connecting an end of said bow forming arm to the base in alignment with the space between the upright plates to enable the bow forming arm to pivot in a vertical plane while pivotally attached to the base and being moveable vertically in generally a horizontal plane when the bow forming arm is disconnected from the base.

11. The bow forming device as defined in claim 10 wherein said means detachably and pivotally connecting the bow forming arm to the base includes a pair of lugs mounted on the base and a pivot pin extending through the lugs and an end of the bow forming arm.

12. The bow forming device as defined in claim 10 wherein said means detachably and pivotally connecting an end of the bow forming arm to the base includes a laterally projecting stud on each side of an end of the bow forming arm, said base including a pair of upstanding spaced lugs receiving the bow forming arm therebetween, an oval shaped opening through each of said lugs receiving the studs, one vertical edge of each of said lugs having a slot formed therein communicating with the oval shaped opening, each of said studs including opposed notches defined by parallel inner surfaces spaced apart a distance generally equal to the height of the slots in the lugs to enable the studs to be moved through the slots when the parallel inner surfaces are aligned with the top and bottom edges of the slots, said slots being above the bottom ends of the oval shaped openings thereby requiring that the end of the forming arm having the studs thereon to be moved vertically into alignment with the slots for movement therethrough.

13. The bow forming device as defined in claim 5 wherein the adjacent edges of said upright plates are bevelled to form a knife edge at the juncture with an inner surface of the upright plate to define a vertically straight, continuous knife edge on each upright plate for gripping engagement with bow forming material inserted between the uprights.

14. The bow forming device as defined in claim 13 wherein the upper adjacent corners of the aligned upright plates are radiused to facilitate entry of bow forming material between the uprights.

15. A bow making device comprising a base, a pair of uprights supported from said base in close adjacent relation and movably biased into gripping engagement with bow forming material therebetween to enable bow loops to be formed in the material, each of said uprights including a pair of spaced parallel upright plates mounted on said base, each pair of upright plates defining a space between the plates with the spaced plates and the spaces therebetween in each upright being aligned, a rigid forming arm closely received in the space between the upright plates in each upright, said upright plates guiding movement of said arm toward the base for moving portions of the bow forming material gripped between the uprights downwardly toward the base.

16. The bow forming device as defined in claim 15 wherein said bow forming arm is an elongated bar having a thickness generally equal to the width of the space between the upright plates, and means pivotally mounting one end of said forming arm to said base for pivotal movement of the forming arm in a vertical plane in the aligned spaces in the uprights.

17. The bow forming device as defined in claim 15 wherein said bow forming arm is positioned horizontally in the aligned spaces in the uprights and moved vertically to move the portions of the bow forming material between the uprights downwardly toward the base.

18. The bow forming device as defined in claim 15 together with means detachably and pivotally connecting an end of said bow forming arm to the base in alignment with the spaces between the upright plates to enable the bow forming arm to pivot in a vertical plane while pivotally attached to the base and being moveable vertically in generally a horizontal plane when the bow forming arm is disconnected from the base.

19. The bow forming device as defined in claim 18 wherein one end of the bow forming arm includes a laterally projecting stud on each side thereof, said base including a pair of upstanding spaced lugs receiving the bow forming arm therebetween, an oval shaped opening through each of said lugs receiving the studs, one vertical edge of each of said lugs having a slot formed therein communicating with the oval shaped opening, each of said studs including opposed notches defined by parallel inner surfaces spaced apart a distance generally equal to the height of the slots in the lugs to enable the studs to be moved through the slots when the parallel inner surfaces are aligned with the top and bottom edges of the slots, said slots being above the bottom ends of the oval shaped openings thereby requiring that the end of the forming arm having the studs thereon to be moved vertically into alignment with the slots for movement therethrough.

20. A bow making device comprising a base, a pair of uprights supported from said base for receiving portions of bow forming material therebetween to enable bow loops to be formed in the material, means mounting at least one of said uprights on the base for relative movement in relation to the other upright and means biasing the moveable upright towards the other upright to clampingly engage portions of the bow forming material between the uprights, each of said uprights including a pair of spaced parallel upright plates, said upright spaced plates and the space therebetween in one pair being aligned with the upright spaced plates and the space therebetween in the other pair, a forming arm received in the aligned spaces between the upright plates for movement toward said base for moving portions of the bow material clampingly engaged by the uprights downwardly toward the base.

* * * * *